US006942102B2

(12) United States Patent
Justice

(10) Patent No.: US 6,942,102 B2
(45) Date of Patent: Sep. 13, 2005

(54) INVERTED OFFICE SHIPPER DISPLAY

(75) Inventor: Timothy Joe Justice, Williston, TN (US)

(73) Assignee: International Paper Company, Stamford, CT (US)

( * ) Notice: Subject to any disclaimer, the term of this patent is extended or adjusted under 35 U.S.C. 154(b) by 375 days.

(21) Appl. No.: 10/384,286

(22) Filed: Mar. 7, 2003

(65) Prior Publication Data

US 2004/0031724 A1 Feb. 19, 2004

Related U.S. Application Data

(60) Provisional application No. 60/362,973, filed on Mar. 8, 2002.

(51) Int. Cl.[7] ..... B65D 1/22
(52) U.S. Cl. ..... 206/746
(58) Field of Search ..... 206/746–750, 206/766, 768, 784, 45.21, 45.22, 45.29, 45.3, 147, 273

(56) References Cited

U.S. PATENT DOCUMENTS

| | | | | | |
|---|---|---|---|---|---|
| 1,462,502 | A | | 7/1923 | Emerson | |
| 1,497,536 | A | * | 6/1924 | Billstein | 206/45.21 |
| 1,925,102 | A | * | 9/1933 | Levkoff | 206/746 |
| 2,113,245 | A | * | 4/1938 | Thomas | 206/45.2 |
| 2,709,031 | A | | 5/1955 | Gondek | |
| 2,790,542 | A | | 4/1957 | Hillman | |
| 2,835,378 | A | | 5/1958 | Sramek | |
| 2,930,516 | A | | 3/1960 | Fowle et al. | |
| 3,552,082 | A | | 1/1971 | Howard | |
| 3,664,494 | A | | 5/1972 | Mergens | |
| 3,850,363 | A | | 11/1974 | Jacobs | |
| 3,942,631 | A | | 3/1976 | Sutherland et al. | |
| 4,000,811 | A | * | 1/1977 | Hardison et al. | 229/242 |
| 4,303,155 | A | * | 12/1981 | Focke et al. | 206/264 |
| 4,784,271 | A | | 11/1988 | Wosaba, II et al. | |
| 4,802,586 | A | | 2/1989 | George | |
| 4,834,242 | A | | 5/1989 | Selack et al. | |
| 5,048,690 | A | * | 9/1991 | Zimmerman | 206/746 |
| 5,443,205 | A | | 8/1995 | Robotham et al. | |
| 5,690,213 | A | * | 11/1997 | Matsumura | 206/45.21 |
| 5,979,662 | A | | 11/1999 | Green | |
| 6,050,420 | A | | 4/2000 | Green | |
| 6,152,305 | A | | 11/2000 | Green | |
| 6,158,579 | A | * | 12/2000 | Rosenbaum | 206/45.29 |
| 6,367,632 | B1 | | 4/2002 | Green | |
| 6,386,371 | B1 | * | 5/2002 | Parsons | 206/768 |
| 6,435,351 | B1 | * | 8/2002 | Gibb | 206/736 |
| 6,478,159 | B1 | * | 11/2002 | Taylor et al. | 206/738 |
| 6,752,262 | B1 | * | 6/2004 | Boriani et al. | 206/45.21 |
| 6,837,379 | B2 | * | 1/2005 | Dennis et al. | 206/767 |

* cited by examiner

*Primary Examiner*—Kurt Fernstrom
(74) *Attorney, Agent, or Firm*—Daniel C. Stelter

(57) ABSTRACT

A container converts into a display tray, wherein the container has a base, a removable lid and a single tear line crossing the removable lid and dividing the lid into two sections of unequal size. The display tray is created by inverting the container and tearing the tear line, physically dividing the lid, whereupon both the smaller section of the lid and the base are removed and discarded, leaving the inverted, larger section of the lid as the display tray.

19 Claims, 5 Drawing Sheets

16

INVERTED OFFICE SHIPPER DISPLAY

RELATED APPLICATION

This application claims priority from U.S. Provisional Application Ser. No. 60/362,973, filed Mar. 8, 2002.

FIELD OF THE INVENTION

The present invention relates to a corrugated container, erected from a unitary paperboard blank, for the holding, stacking and transporting of items such as reams of paper. In particular, the present invention relates to a corrugated container with a perforated tear score line scored into the container's removable lid, such that a display box is created when the container is inverted and torn along the tear score line.

BACKGROUND OF THE INVENTION

Corrugated paperboard is typically used in many different applications, for example, to form containers, boxes, cartons, or dividers for holding, storing, stacking or shipping various items, such as reams of paper utilized in copiers and printers.

Typically, such containers have a bottom, four side walls and a removable lid, and are formed from blanks scored with score or cut lines, wherein the container's base and removable lid each are erected from separate blanks. Each blank is most often scored by automated machines in a continuous in-line process involving cutting, scoring and molding continuous sheets of paperboard. The paperboard is then erected by the automated machine along the score lines or cut lines to form a base or the removable lid. Alternatively, the blanks may be erected into a container by a consumer or other manual means. For full assembly of the container, once the lid and base have been erected, the removable lid is placed over the base in a secure yet non-bonded manner.

Frequently, containers are utilized for holding commercial products to be shipped to retail stores and outlets for the sale and display of the products. With a basic container, when the retail establishment wishes to display the products held inside, a user must open the container, remove the products, and place the products on a display tray or stand, a time consuming process. Thus, retail establishments often prefer a shipping container that can be converted into a display tray. This enables a user to display the goods quickly on a shelf without first removing the products from the box, and can create impromptu and self-sufficient display trays where no such means previously existed, saving costs.

With respect to the shipping of reams of office paper, converting a container to a display tray is problematic. Usually, such containers that are designed to convert into a display tray have a single side panel that is scored or perforated. To convert the container, the lid is removed and discarded. The perforated side panel is then torn and removed from the base, displaying the paper inside. However, a perforation along a side wall of the container's base is not an optimal solution. First, the integrity of the container is compromised by scoring the container base, significantly reducing the overall strength of the container. Second, tearing away a single side panel often tears away more of the container than intended, resulting in torn or frayed edges, or a generally unattractive display.

Therefore, it is an object of this invention to provide a convertible paperboard shipper display container that does not compromise the strength of the container's base with perforated lines and allows for easy and clean tearing of the paperboard container.

SUMMARY OF THE INVENTION

The present invention comprises a shipping container that can be readily and easily converted into a display tray by inverting the container and tearing along a tear score line scored in the container's removable lid. Having a tear score line in the lid as opposed to the base maintains the container's strength by avoiding the perforation of the load bearing part of the container (the base).

The removable lid is formed from a blank having four side panels foldably connected to a top panel along fold lines, wherein the tear score line crosses two opposing side panels and further extends along at least one fold line, dividing the lid into two separate sections of unequal size. The tear score line does not cross or encroach the top panel. The container's base may be any typical container base, for example, with a bottom panel, two side walls and two end walls foldably attached to the bottom panel, and two side flaps foldably attached to each opposing side wall.

A tear strip or filament, commonly known as tear tape, may be attached to the container along the inner surface of the perforated tear line to facilitate clean and easy tearing. The tear tape may further contain a tear flap attached to the ends of the tear score line that extends outwardly from the lid, enabling a user to grip and access the tear tape for the purpose of tearing.

A display case is created by first inverting the container such that the lid is beneath the base of the container and the base rests on top of the lid. Next, the tear score line is torn and the smaller section of the lid outlined by the tear score line is removed and discarded. Finally, the base of the container is removed in an upwards direction. The remaining display comprises the entirety of the lid's top panel, the entirety of one back wall and portions of two opposing side walls. The front wall and portions of two opposing side walls are removed.

Other objects, embodiments, features and advantages of the present invention will be apparent when the description of a preferred embodiment of the invention is considered in conjunction with the annexed drawings, which should be construed in an illustrative and not limiting sense.

BRIEF DESCRIPTION OF THE FIGURES/ DRAWINGS

FIG. 4*a*–4*d* is an action flow chart showing a method for creating a display tray by inverting the container.

Figure 5:
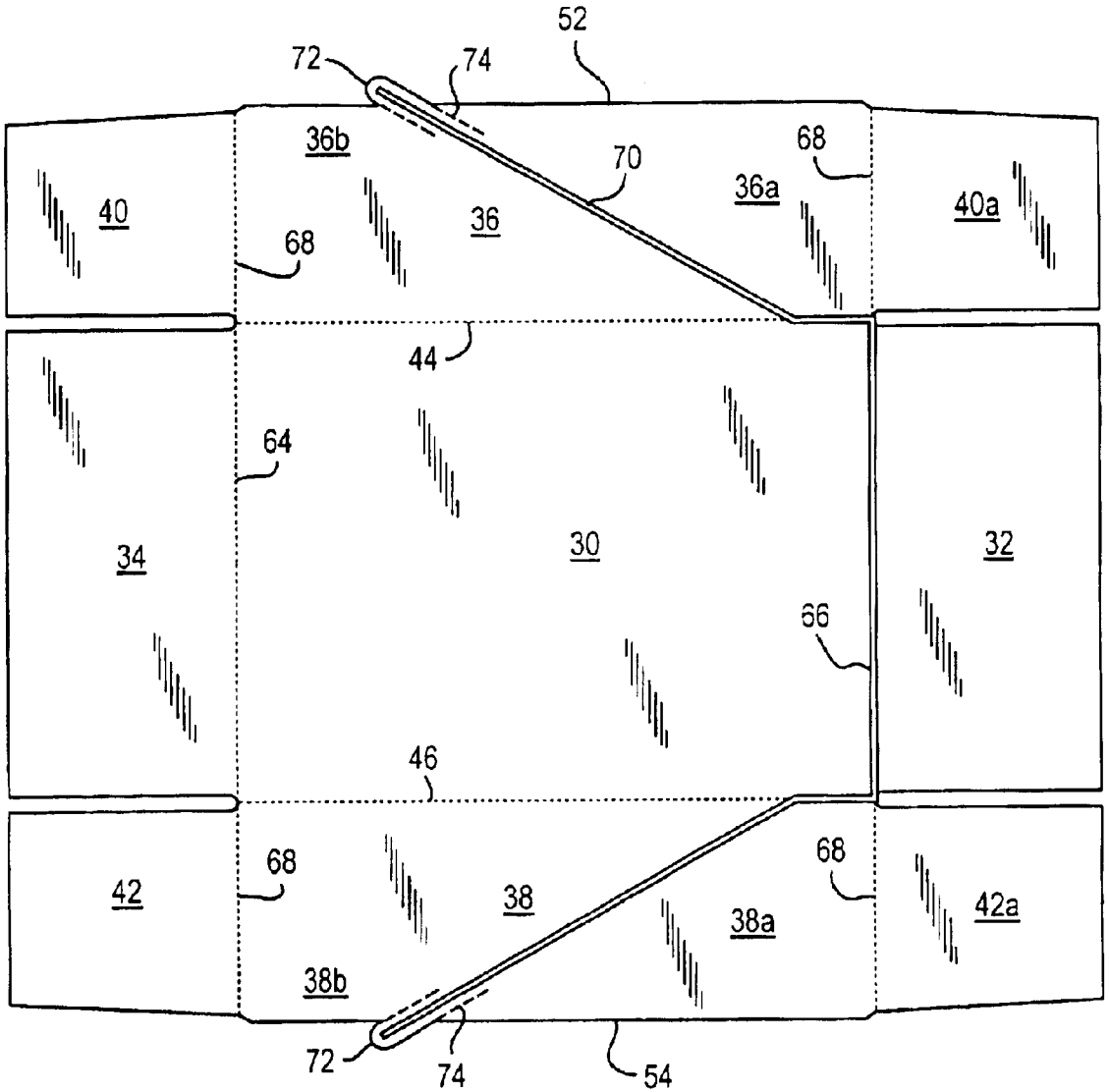

FIG. 5 is a plan view of a paperboard blank for forming a removable lid with tear tape.

DETAILED DESCRIPTION

Figure 1:
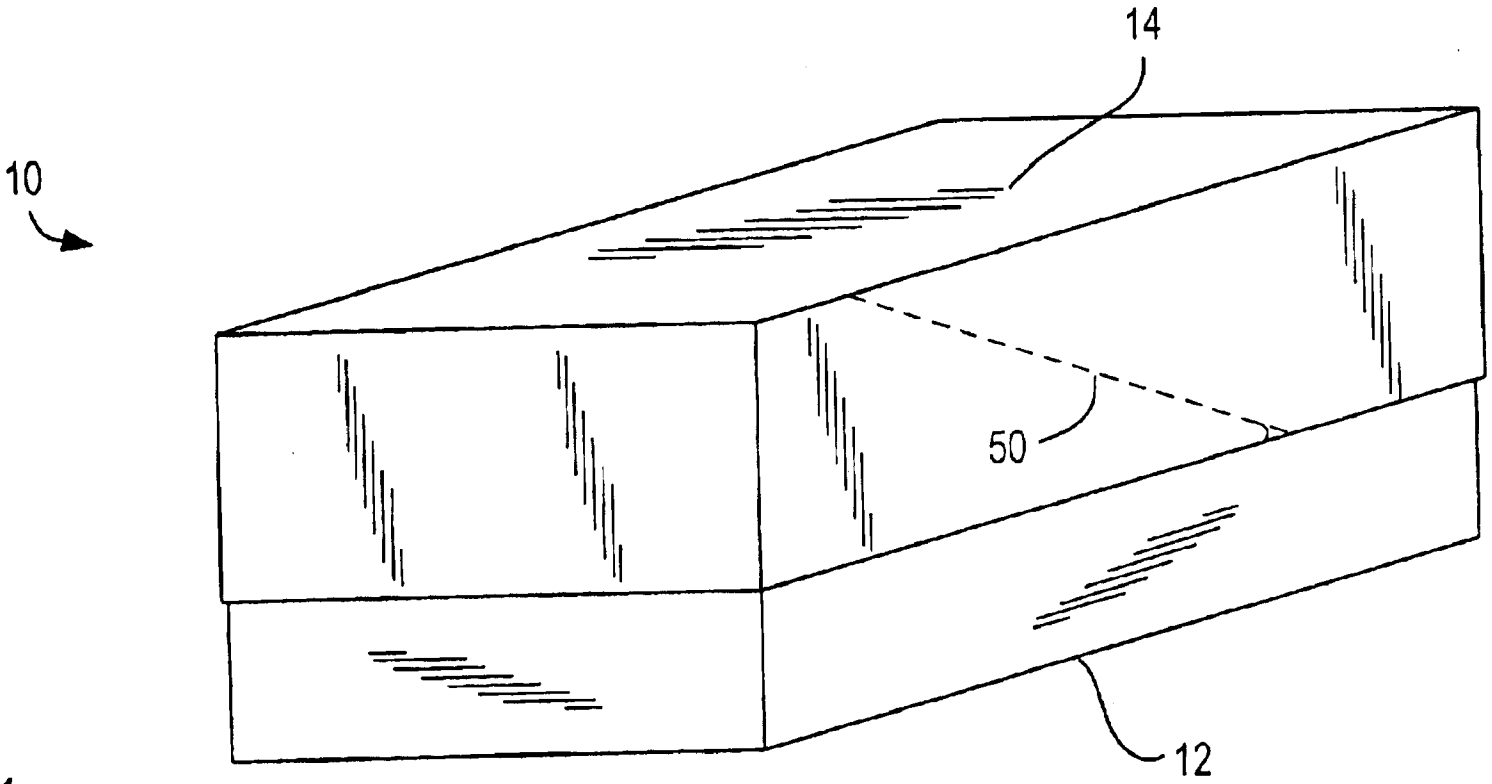
FIG. 1 is a perspective view of the shipping container, including a base and a removable lid.

A paper or paperboard container in accordance with one embodiment of the invention is shown in FIG. 1. Container 10 is erected having a base 12 for holding consumer goods or other items, and a removable lid 14 fitted onto the base in a secure but non-bonded arrangement, wherein the lid can be removed by a pulling motion in an upwards direction. Tear score line 50 is visible along the side edges of the lid, thereby leaving base 12 free of any score lines that may comprise or reduce its strength.

Figure 2:
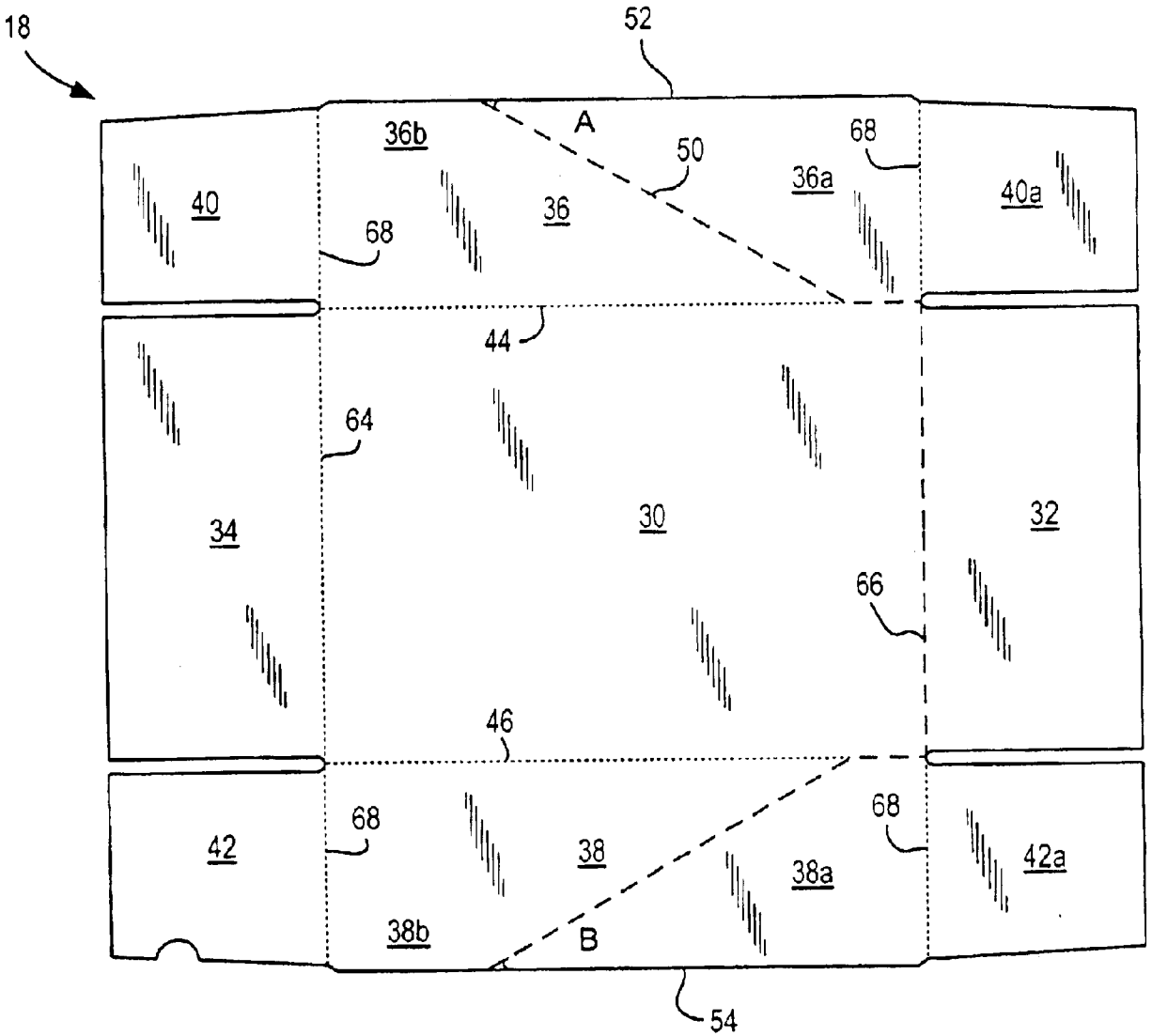
FIG. 2 is a plan view of a paperboard blank for forming the removable lid.

Lid 14 may be formulated from blank 18, shown in FIG. 2. The blank is preferably a flat corrugated paper or paperboard of single or multi-ply thickness and made of any material known that is suitable for shipping, stacking and transporting a wide variety of items. Top panel 30 is a large, rectangular panel, preferably of sufficient size to support a ream, or multiple reams, of office, printer or copier paper. Parallel end fold lines 66 and 64 border the top panel on two opposing sides. Parallel side fold lines 44 and 46 border the top panel 30 on the remaining two opposing sides.

End panels 32 and 34 foldably connect to top panel 30 along fold lines 66 and 64, respectively. Likewise, side panels 36 and 38 foldably connect to top panel 30 along fold lines 44 and 46, respectively.

Each side panel is bordered by the top panel, an outer edge, and two side flaps foldably connected on opposites sides. Side panel 36 has outer edge 52 and flaps 40 and 40*a*, and panel 38 has outer edges 54 and flaps 42 and 42*a*.

Tear score line 50 divides lid 14 into two sections by entirely crossing the blank from outer edge 52 to outer edge 54 without ever crossing top panel 30. In a preferred arrangement, score line 50 extends from outer edge 52 at an angle A toward fold line 44, thereby crossing side panel 36. The score line preferably crosses panel 36 on a diagonal, with angle A equaling about 30°, but this exact angle is not required. Instead, the score line can cross from any point on outer edge 52 to any point of fold line 44. For example, angle A can be 90°, whereby the score line crosses panel 36 in a vertical line perpendicular to the outer edge and the fold line. Conversely, the score line may extend from one extreme edge of outer edge 52 to the opposing extreme edge on fold line 44, thereby diagonally bisecting panel 36 into two equivalent triangles. Further, the score line may extend from a point closer to flap 40 to a point closer to flap 40*a*, or vice versa. As a result, a wide range of angles may be substituted for angle A.

In the embodiment shown in FIG. 2, side panel 36 is divided by score line 50 into a smaller section 36*a* and a larger section 36*b*. Score line 50 then extends directly on fold line 44 toward end fold line 66. In other embodiments, score line 50 angles directly into the intersection of fold line 44 and fold line 66. In these circumstances, score line 50 does not have to extend directly on fold line 44 for a portion of that fold line's length.

Upon reaching fold line 66, tear score line 50 angles 90° and extends along the entire length of fold line 66. At the intersection of fold lines 66 and 46, the tear line angles again and may extend partially along fold line 46 before extending from fold line 46 to outer edge 54 across side panel 38. Much like the division of panel 36, score line 50 may cross side panel 38 by any angle, and in any direction, as long as the score line extends from some point on fold line 46 to some point on outer edge 54. For aesthetic reasons, it is preferred that angle B is the same as angle A, but this is not a required feature to achieve the invention's functionality. In the present embodiment, panel 38 is divided into smaller section 38*a* and larger section 38*b*, with angle B equaling about 30°.

The tear score line can be either a perforated score line by itself, or a perforated score line with a tear tape attached to it, as shown in FIG. 5. Tear tape 70 is any tape or tearing filament well known in the art for the purpose of tearing a flexible material such as paperboard. Such tape enables a user external to the lid to fully tear through the thickness of the lid when the tear tape is pulled. Ideally, the tear tape is attached to the inner surface of the tear score line to facilitate a complete tear, the inner portion of the tear score line being the portion of the score line that is only visible from the interior of the lid when the lid is erected. The tear tape may also contain tear tab 72, integrally connected to one side of the tear tape, that extends outwardly from the edge of the container and enables a user to better grip the tear tape prior to and during the tearing process. Tear cut lines 74 may also be scored to facilitate the tear. In other embodiments, the lid may container tear tape 70 without score line 50.

As a result, referring to FIG. 2, tear score line 50 divides the entire top panel into two sections. The smaller section comprises panels 32, 36*a*, 38*a*, 40*a* and 42*a*. This section is removed and discarded when the top is converted into a display tray. The larger section comprises the entirety of top panel 30 and panels 34, 36*b*, 38*b*, 40 and 42, and corresponds to the display tray when the lid is erected and torn along tear line 50.

To erect blank 18 into a lid, the container is preferably folded along the fold lines and erected by a machine in a continuous in-line process. Blank 18 is first folded along the horizontal axis of fold lines 44 and 46, lifting side panels 36 and 38 and side flaps 40, 40*a*, 42 and 42*a* upwards, out of the horizontal plane of top panel 30. Side flaps 40, 40*a*, 42 and 42*a* are then folded 90° along the vertical axis of fold lines 48 towards the top panel. Finally, end flaps 32 and 34 are folded upwards along horizontal fold lines 66 and 64 and are adhered to the back sides of the side panels with an adhesive. The adhesive used can be any adhesive known in the art for the purpose of bonding corrugated paper together. Alternative embodiments include utilizing non-adhesive bonding materials, such as staples, to erect and secure the lid.

Lid blanks of alternate sizes, or with different size ratios of the individual panel of the blanks than those depicted in FIG. 2, can be easily achieved while maintaining the spirit of the invention. For example, thinner objects can be accounted for by changing the length of the side and end panels. Smaller items can be accounted for by adjusting the size of the top panel.

Figure 3:
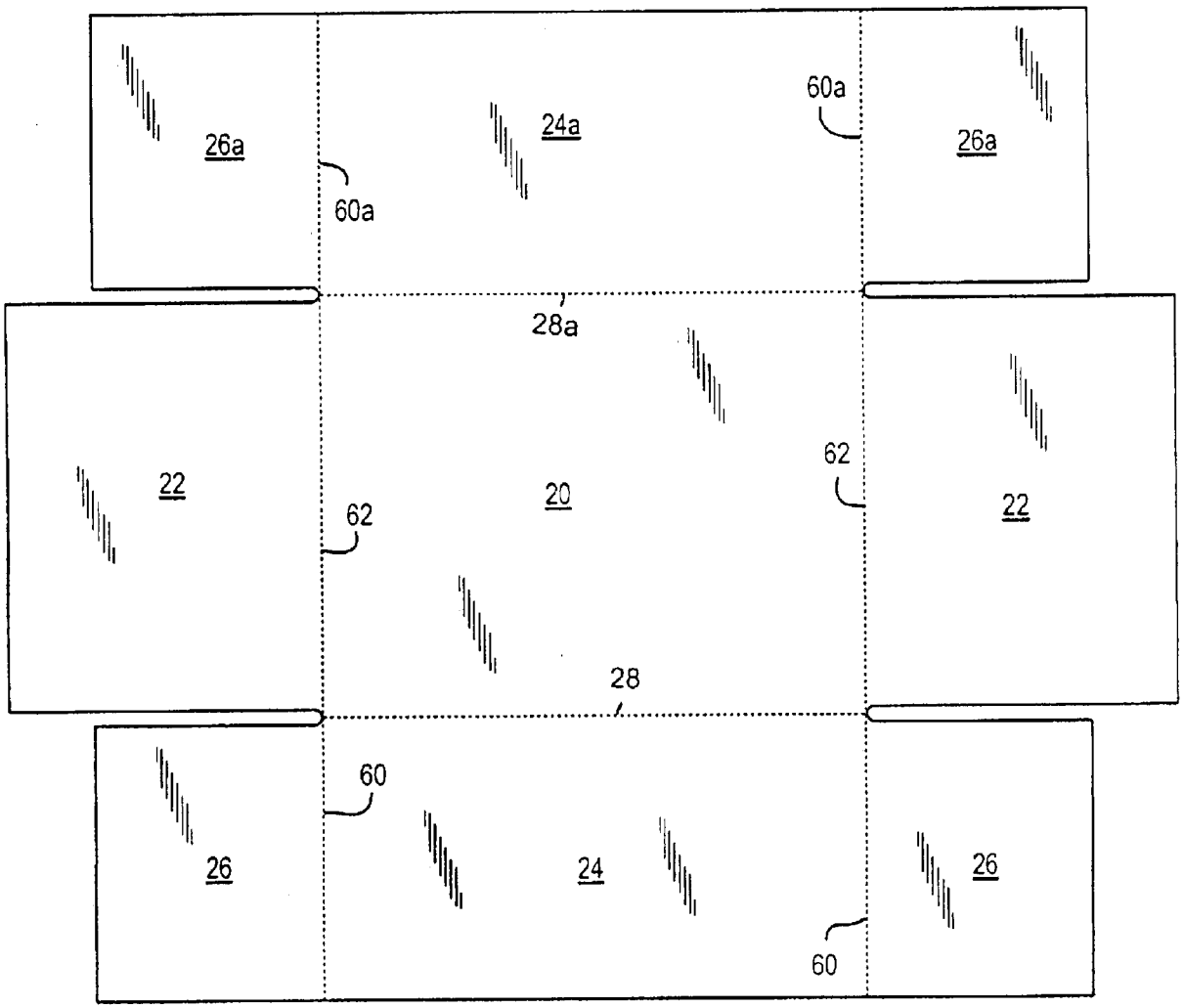
FIG. 3 is a plan view of a paperboard blank for forming the base.

Base 12 of the container of the present invention is formulated from blank 16 shown in FIG. 3. The base is constructed for the purpose of holding, shipping or stacking a wide variety of objects, such as reams of office, printer or copier paper. As a result, the blank is preferably a flat corrugated paper or paperboard made of a material known that is suitable for the shipping and transporting a wide variety of consumer items. For example, if one were to package heavier materials, a thicker grade may be advisable. Further, the strength of the paper or paperboard can be increased by having a thickness of more than one ply (multi-ply paperboard). The grade of paper is preferably the same grade used for the removable lid, although it is not essential.

Blank 16 has a rectangular bottom panel 20 bordered on four sides by end fold lines 62 and side fold lines 28 and 28*a*. End panels 22 foldably connect to the bottom panel along fold lines 62. Side panels 24 and 24*a* foldably connect to the bottom panel along fold lines 28 and 28*a*, respectively. Each side panel is bordered by the bottom panel, an outer edge, and two side flaps foldably connected on opposites sides. Side panel 24 is foldably connected to flaps 26 along score lines 60, and panel 24*a* is foldably connected to flaps 26*a* along score line 60*a*. The container base is erected in the same manner as the lid, with the side and end panels folded upwards, 90° out of the plane of base panel 20, with end panels 24 and 24*a* attaching to the backs of side flaps 26 and 26*a*.

Figure 4A:
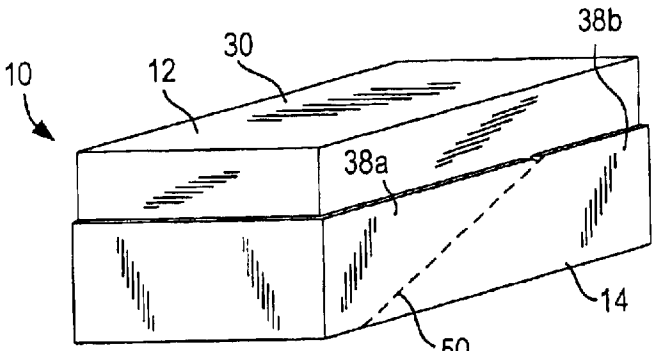
Figure 4B:
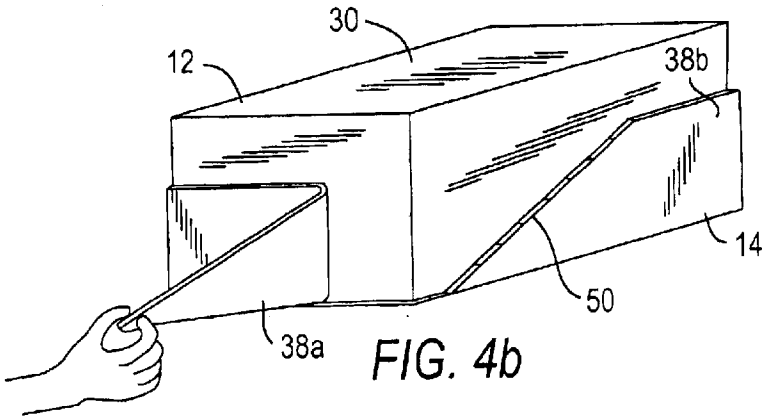
Figure 4C:
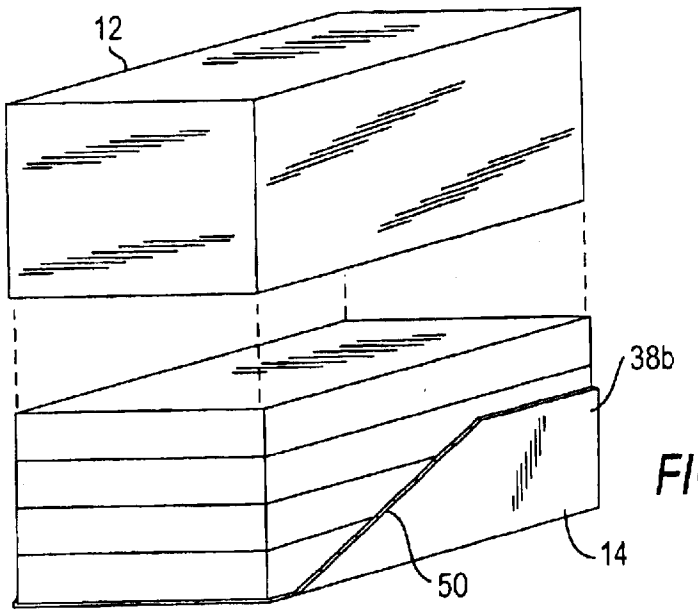
Figure 4D:
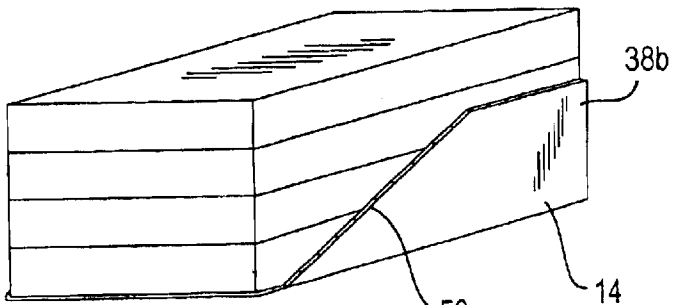

The display tray is created by the process outlines in FIGS. 4*a*–4*d*. The container of FIG. 1 is created by placing the removable lid on top of the container base. The entire container is then turned upside-down to form the inverted container of FIG. 4*a*. Tear line 50 is then torn in FIG. 4*b*. The tear line is torn in a single, continuous motion extending from one side of the container to the opposing side. The container base is preferably left on top of the lid to keep the contents of the container steady during tearing. However, the base is not required for proper function of the tearing and may be removing prior to the tear. Further, the tear motion may be aided by a tear tape or a tear flap connected to one side of the tear tape to facilitate the tear by aiding the grip of the user. The base is then removed in an upward motion pursuant to FIG. 4*c*, if it wasn't already done prior to the tearing step of FIG. 4*b*. The final display tray is shown in FIG. 4*d*. The tray comprises the entirety of the lid's top panel (which corresponds to the display tray's bottom panel), the entirety of one side wall (corresponding to the back of the tray), and parts of two opposing side walls (corresponding to the tray's opposing side walls.) The front wall of the tray is completely removed. The entire front and most of the side of the container's contents is visible and accessible, providing ample display and easily retrieval of the goods.

While the preferred embodiments of the invention has been illustrated and described, it will be appreciated that various changes can be made therein without departing from the spirit and scope of the invention. Although the invention has been described with reference to preferred embodiments, it will be appreciated by one of ordinary skill in the art that numerous modifications are possible in light of the above disclosure. For example, this display tray may have side walls that extend higher to increase the protection of the goods inside. Similarly, the angles of the tear score line can be altered to increase or decrease side access of the goods, or simply for aesthetic reasons. All such variations and modifications are intended to be within the scope and spirit of the invention as defined in the claims appended hereto.

I claim:

1. A container comprising a base and a top, wherein said base has a base panel and four side walls formed from a unitary blank, and said top has a top panel, a first and second opposing end wall foldably attached to said top panel along a first and second opposing end score line, a first and second opposing side wall foldably attached to said top panel along a first and second opposing side score line, and a continuous tear line extending from one side wall to the opposing side wall.

2. The container according to claims 1, wherein said tear line extends from said first side wall to said second side wall along said first end fold line.

3. The container according to claim 1, wherein said tear line partially extends along portions of said first and second side fold line.

4. The container according to claim 1, wherein the first and second opposing side wall each have a top edge, a bottom score line, and two side score lines, wherein the tear line extends from a point on the top edge of each side wall to a point on the bottom score line of each side wall.

5. The container according to claim 4, wherein said tear line extends diagonally across said first and second opposing side wall.

6. The container according to claim 1, further comprising a tear filament extending along the tear line on an inner surface of the top.

7. The container according to claim 6, wherein the tear filament further comprises at least one tear flap attached to at least one end of the filament, wherein at least a portion of said at least one flap extends outwardly from the top.

8. A unitary blank for a removable lid for use on a container base, comprising a top panel, first and second opposing end panels foldably attached to said top panel along first and second opposing end score lines, first and second opposing side panels foldably attached to said top panel along first and second opposing side score lines, and a continuous tear line extending from an outer edge of one side panel to an outer edge of the opposing side panel.

9. The unitary blank according to claims 8, wherein said tear line extends from said first side panel to said second side panel along said first end score line.

10. The unitary blank according to claims 8, wherein said tear line partially extends along portions of said first and second side score line.

11. The unitary blank according to claims 8, wherein the tear line extends from the a point on the outer edge of each side wall to a point on the side score lines of each side wall.

12. The unitary blank according to claims 11, wherein said tear line extends diagonally across said first and second opposing side panels.

13. The unitary blank according to claims 8, further comprising a tear filament extending along the tear line on an inner surface of the blank.

14. The container according to claim 13, wherein the tear filament further comprises at least one tear flap attached to at least one end of the filament, wherein at least a portion of said at least one flap extends outwardly from the lid.

15. A method for converting a container having a base and a removable lid into a display tray, comprising the steps of:

inverting said container such that said base rests on top of said removable lid, tearing a score line from a top edge of a side wall of the lid to a top edge of an opposing side wall of the lid with a single tear, leaving a top panel of said lid intact, to form a disposable portion of the lid, removing the disposable portion of the lid, and removing said base.

16. The method according to claim 15, wherein said score line is torn diagonally across said side walls, laterally along portions of an opposing side fold lines between said side walls and a top panel, and laterally across the entirety of an end fold line between said top panel and said end wall.

17. The method according to claim 15, wherein a tear filament is pulled to tear the score line.

18. The method according to claim 17, wherein at least one tear tab is integrally attached to at least one end of the tear filament, providing a grip to tear the tear score line.

19. The method according to claim 15, wherein said base is removed with a vertical motion.

* * * * *